US009623307B1

(12) United States Patent
Devor

(10) Patent No.: US 9,623,307 B1
(45) Date of Patent: Apr. 18, 2017

(54) GAME SYSTEM

(71) Applicant: Patrick Devor, Indianapolis, IN (US)

(72) Inventor: Patrick Devor, Indianapolis, IN (US)

( * ) Notice: Subject to any disclaimer, the term of this patent is extended or adjusted under 35 U.S.C. 154(b) by 0 days.

(21) Appl. No.: 14/921,627

(22) Filed: Oct. 23, 2015

(51) Int. Cl.
*A63B 63/00* (2006.01)
*A63B 67/06* (2006.01)

(52) U.S. Cl.
CPC ..... *A63B 67/06* (2013.01); *A63B 63/00* (2013.01); *A63B 2210/50* (2013.01)

(58) Field of Classification Search
CPC ..... A63B 67/06; A63B 63/00; A63B 2210/50; A63B 71/0036
USPC ..... 273/398–402; 206/742, 751, 752, 754, 206/756, 762, 45.2, 45.23, 45.24
See application file for complete search history.

(56) References Cited

U.S. PATENT DOCUMENTS 406,342 A * 7/1889 Dumont ..... A63B 67/06 273/402
467,964 A * 2/1892 Watt ..... B65D 5/5206 206/45.23
569,140 A * 10/1896 Nurick ..... A63F 9/02 273/352
701,658 A * 6/1902 Wixcel ..... B65D 5/5206 190/16
922,717 A * 5/1909 Parker ..... A63B 67/06 273/401
1,461,656 A * 7/1923 Harned ..... B65D 5/5206 206/45.23
1,542,063 A * 6/1925 Knight ..... A63F 9/0204 124/7
1,636,920 A * 7/1927 Nichols ..... A63F 9/0204 273/402
1,996,986 A * 4/1935 Weinberg ..... A63F 9/0204 273/400
3,035,838 A * 5/1962 Johnston ..... A63F 9/0204 273/400
3,088,738 A * 5/1963 Meyer ..... F41J 3/0004 206/45.2
3,561,762 A * 2/1971 Russell ..... A63F 7/0612 206/45.3
4,243,229 A * 1/1981 Huser ..... A63F 9/0204 273/402
4,982,966 A * 1/1991 Teafatiller ..... A63B 67/06 273/336
5,050,889 A * 9/1991 Walker ..... A63F 9/0204 273/402

(Continued)

*Primary Examiner* — Mark Graham
(74) *Attorney, Agent, or Firm* — C. John Brannon; Brannon Sowers & Cracraft PC

(57) ABSTRACT

A game kit, including an elongated rectangular box portion defining a recess, first and second elongated rectangular panel members hingedly connected to the box portion, a first central and a pair of ancillary pipes operationally connected to the first elongated rectangular panel portion, wherein each ancillary pipe is equidistant from the first pipe, a slot formed in the first elongated panel member opposite the first and ancillary pipes for receiving the proximal edge, and a plurality of bean bags. When the box portion placed on a generally flat surface, pivoting the first elongated rectangular panel member into a generally vertical orientation and pivoting the second elongated rectangular portion to engage the proximal edge with the slot deploys the first and ancillary pipes in a generally vertical orientation for receiving tossed bags.

3 Claims, 6 Drawing Sheets

(56) References Cited

U.S. PATENT DOCUMENTS

| | | | | | |
|---|---|---|---|---|---|
| 5,201,527 | A * | 4/1993 | Koket | A63B 71/0036 | 273/402 |
| 5,332,230 | A * | 7/1994 | Benedict | A63B 67/06 | 273/400 |
| 5,788,242 | A * | 8/1998 | Rudell | A63B 69/0071 | 273/317.3 |
| 7,325,682 | B2 * | 2/2008 | Seymour | B25H 3/003 | 206/379 |
| 7,500,674 | B2 * | 3/2009 | Riley | A63B 67/06 | 273/126 R |
| 7,607,666 | B1 * | 10/2009 | Studier | A63B 63/00 | 116/222 |
| 8,235,880 | B2 * | 8/2012 | Guier | A63B 69/3676 | 206/315.9 |
| 8,651,492 | B1 * | 2/2014 | Cappuccio | A63B 67/002 | 273/317 |
| 2012/0169012 | A1 * | 7/2012 | Parker | A63B 67/002 | 273/400 |
| 2014/0265136 | A1 * | 9/2014 | Parker | A63B 63/00 | 273/398 |
| 2015/0069708 | A1 * | 3/2015 | Mashburn | A63B 67/06 | 273/400 |

* cited by examiner

GAME SYSTEM

BACKGROUND

It is important to learn basic concepts such as motor coordination, simple spatial relationships, how to follow simple directions, and how to deal with setbacks in a mature and sportsmanlike manner. As these simple skills are mastered, more complex skills may be acquired, such as how to plan competitive strategies and how to take advantage of opportunities as they present themselves.

One way of acquiring such basic skills is through the playing of educational games that make the learning process fun and entertaining. While many such games have been developed, none effectively combine the teaching of colors, spatial relationships, and strategy with simple, easy to comprehend instructions. Hence, there is a need for an improved educational game capable of teaching colors, spatial relationships, strategy and sportsmanship and of being easily understood and played by anyone, including young children. A means for satisfying this need has so far eluded those skilled in the art.

DETAILED DESCRIPTION

Figure 1:
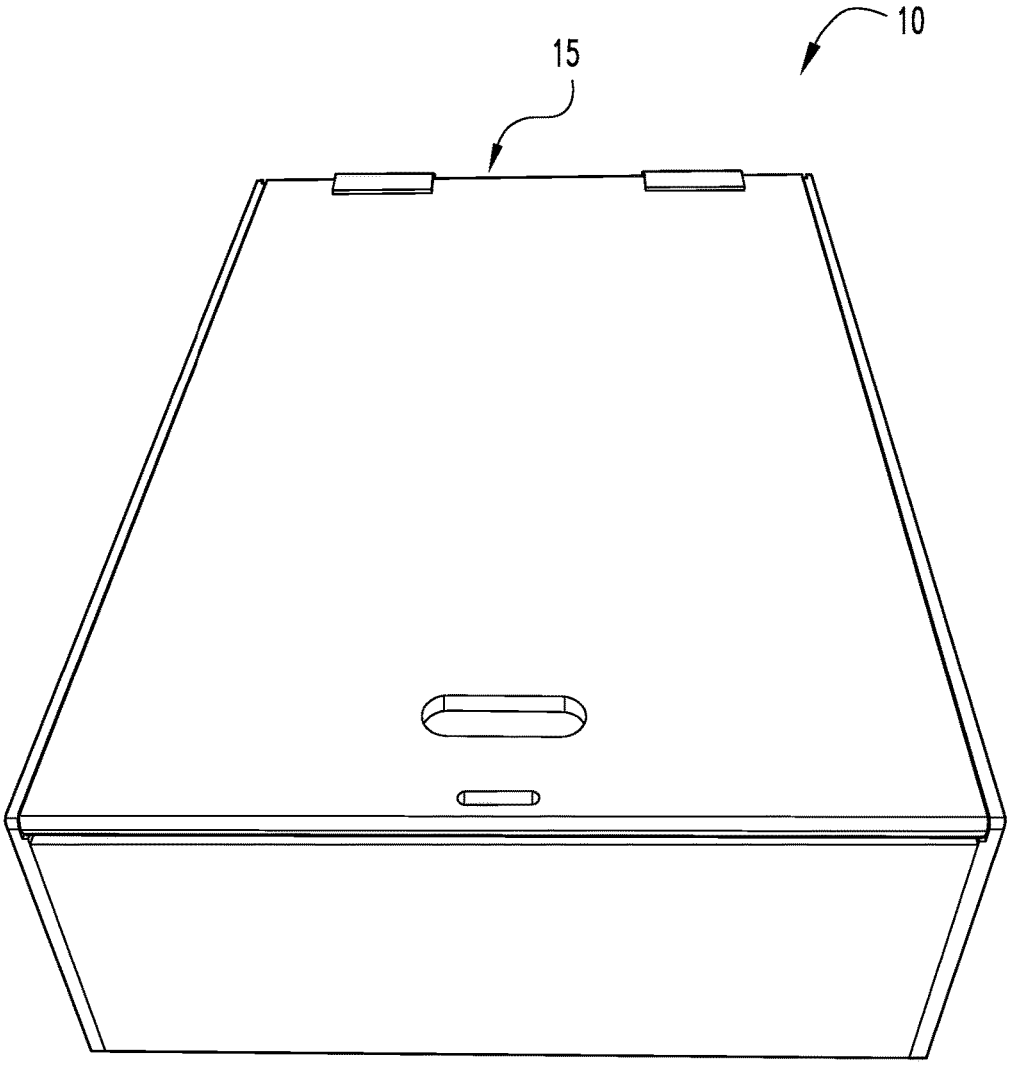
FIG. 1 is a perspective view of a first embodiment game system of the present novel technology.
Figure 2:
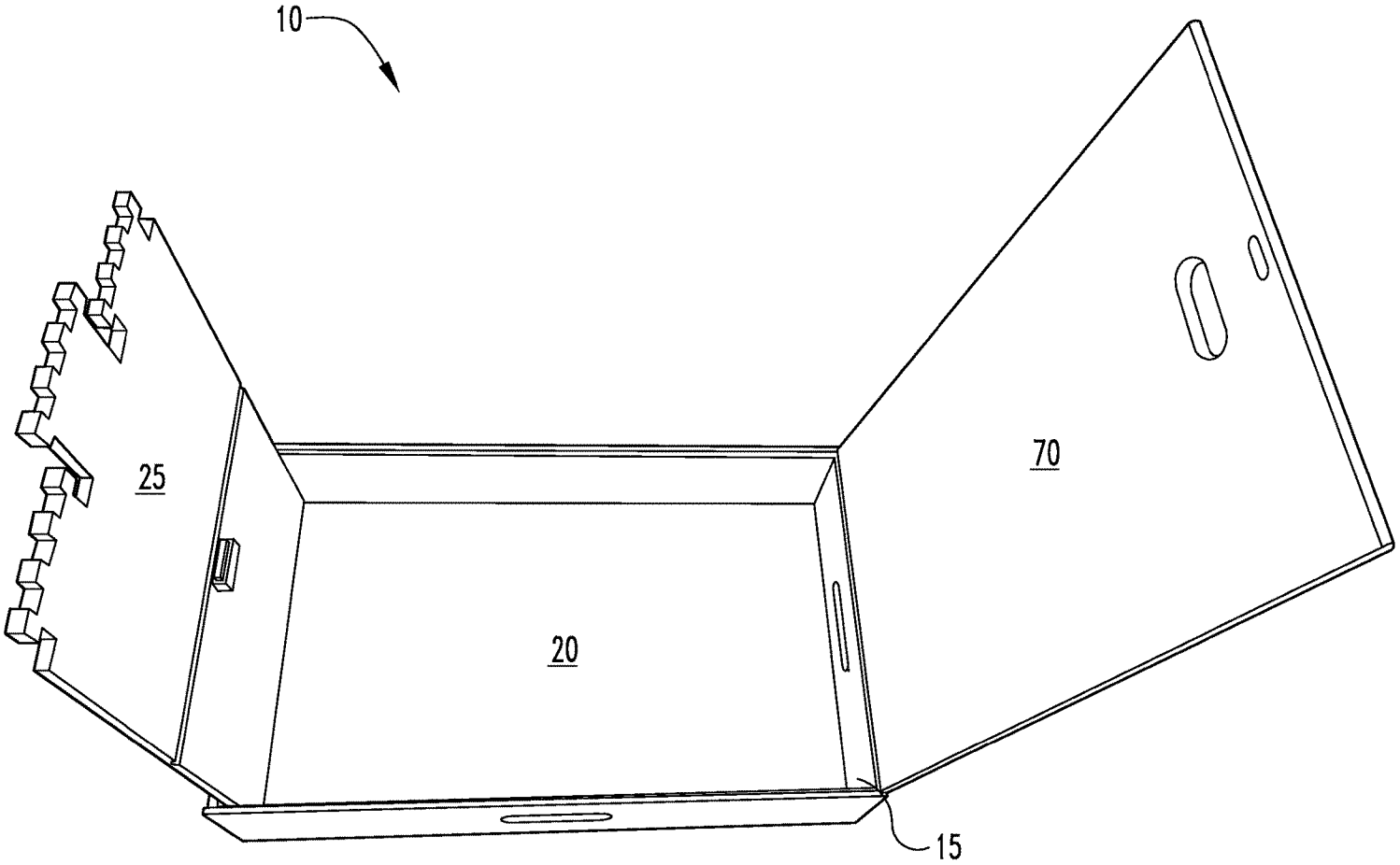
FIG. 2 is a second perspective view of the system of FIG. 1 with pivotable panels deployed.
Figure 3:
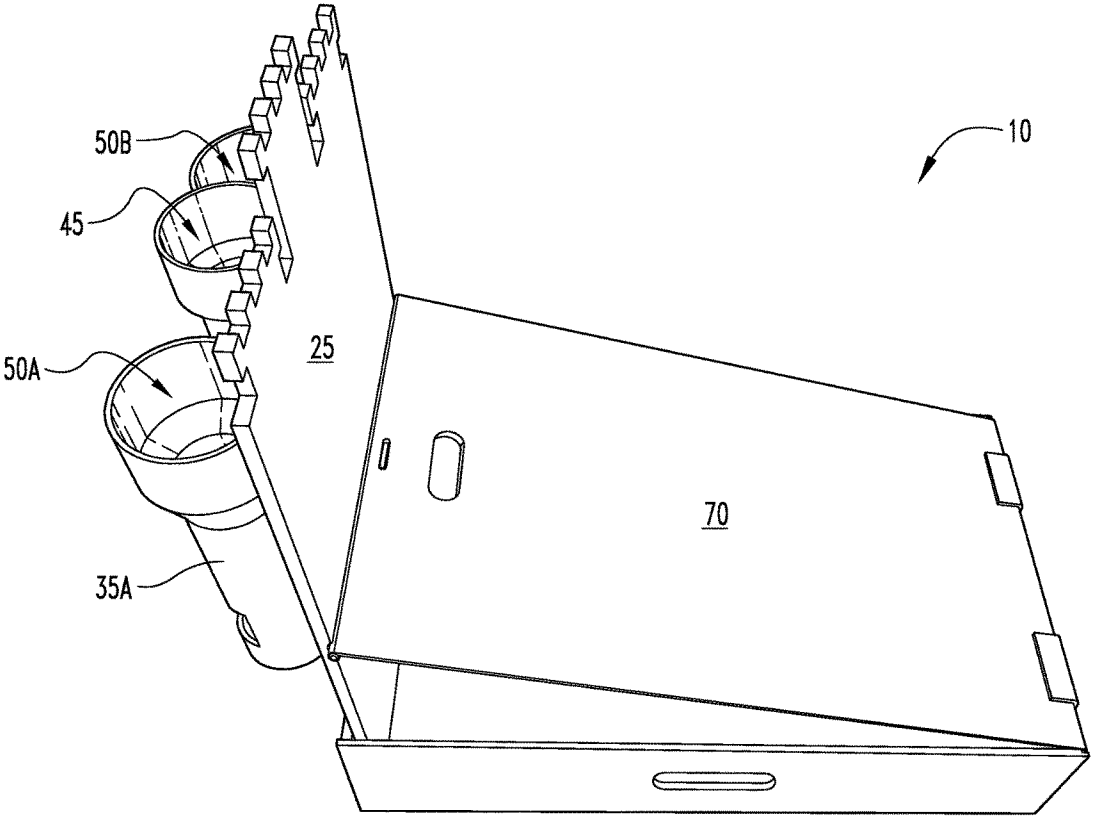
FIG. 3 is a third perspective view of the system of FIG. 1 with pivotable panels engaged with each other.
Figure 4:
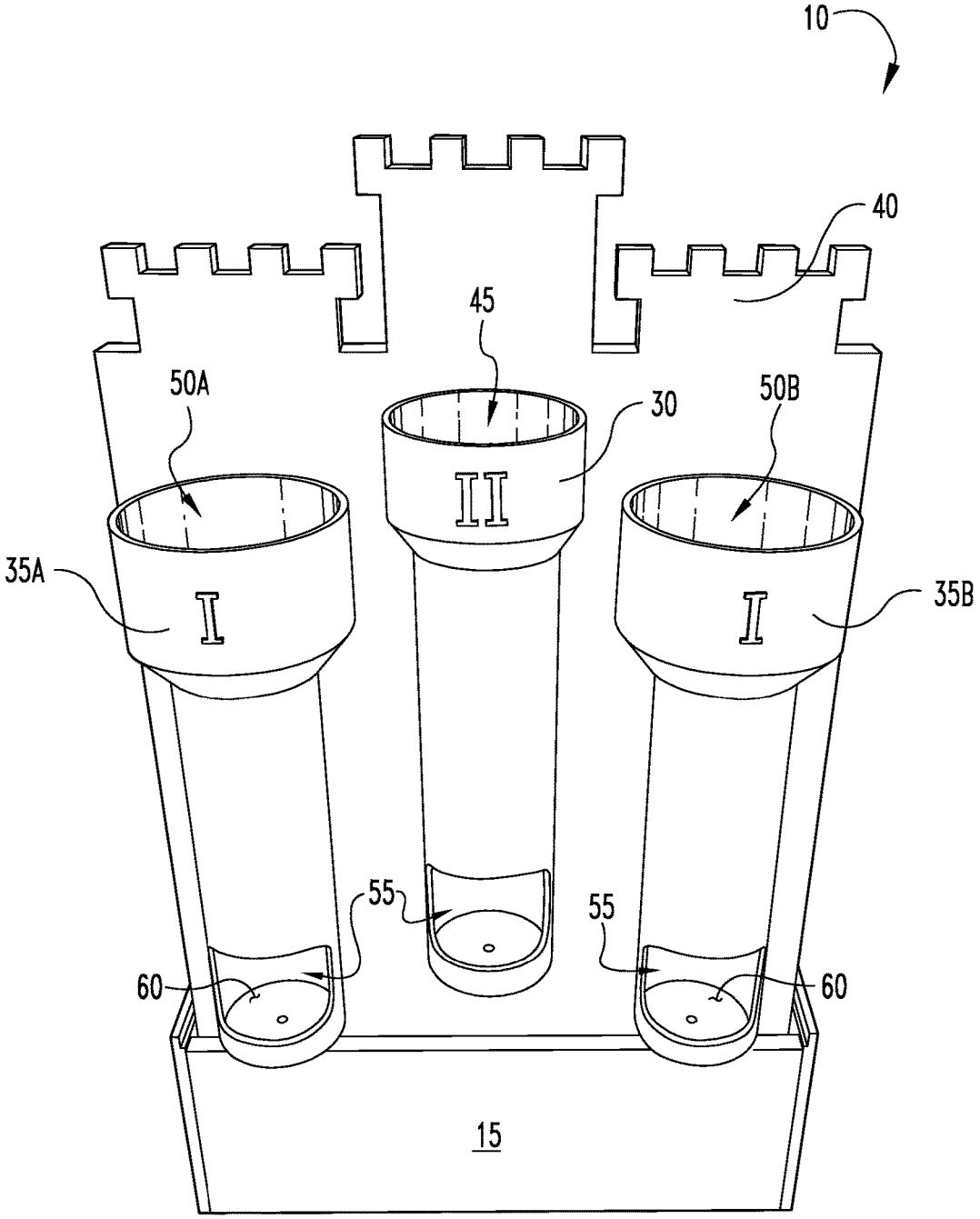
FIG. 4 is a front elevation view of FIG. 3.
Figure 5:
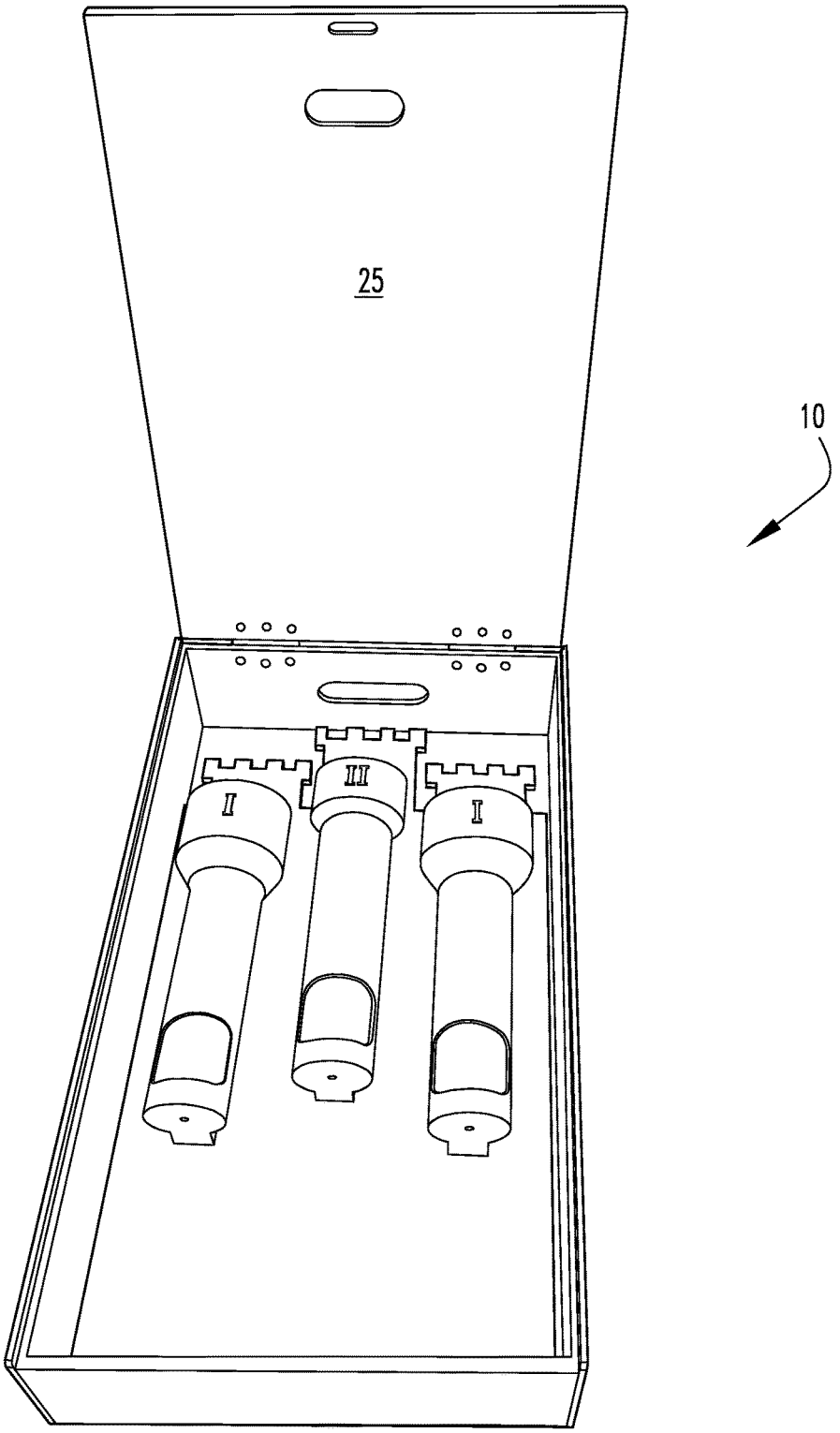
FIG. 5 is a front perspective view of the system of FIG. 1 with the first panel pivoted into the recess.
Figure 6:
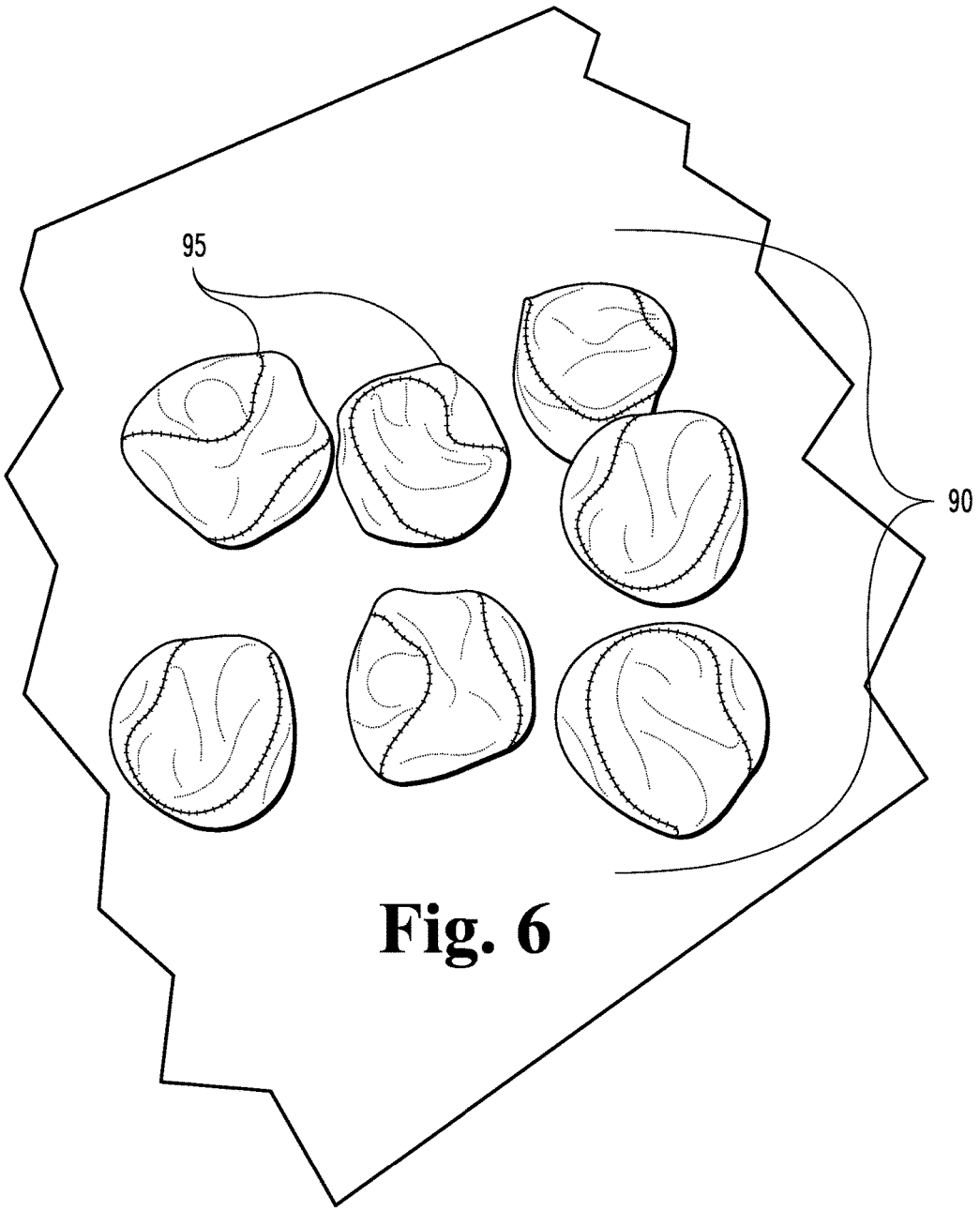
FIG. 6 is a perspective view of a plurality of throwing objects for use with the system of FIG. 1.

For the purposes of promoting an understanding of the principles of the novel technology and presenting its currently understood best mode of operation, reference will now be made to the embodiments illustrated in the drawings and specific language will be used to describe the same. It will nevertheless be understood that no limitation of the scope of the novel technology is thereby intended, with such alterations and further modifications in the illustrated device and such further applications of the principles of the novel technology as illustrated therein being contemplated as would normally occur to one skilled in the art to which the novel technology relates.

FIG. 1 illustrates a first embodiment of the present invention. A game kit 10 is shown consisting of a shallow, typically rectangular, elongated box 15 defining a recess 20 and having a first hinged panel 25 connected thereto and pivotable into the recess 20. Central 30 and ancillary 35A,B pipes are connected to one surface 40 of panel 25, typically the surface 40 facing away from the recess 20. Central pipe 30 is typically positioned between ancillary pipes 35A, B, and is more typically positioned equidistant to pipe 35A and pipe 35B. Central pipe 30 top opening 45 diameter typically has a lesser diameter than do the top openings 50A, B of ancillary pipes 35A, B, and the top openings 50A, 50B of ancillary pipes 35A, B typically of the same diameter. Pipes 30, 35A, 35B are typically generally cylindrical and include respective openings 45, 50A, 50B at one end and are closed by panels 60 at the respective opposite ends. Pipes 30, 35A, 35B typically have respective openings 55 formed therethrough and are typically positioned adjacent the respective bottom panels 60.

Pipe openings 45, 50A, 50B may be made larger or smaller, such as by inserting aperture flanges or the like to narrow the openings 45, 50A, 50B or by attaching conical or frustoconical segments to effectively enlarge the openings 45, 50A, 50B, so as vary the difficulty level of play. 45, 50A, 50B First hinged panel 25 is typically rectangular and is sized to fit into elongated box 15. Panel 25 may be pivoted into box 15 for storage and out of box 15 for deployment in a generally upright orientation for game play. Second hinged panel 70 is hingedly connected to box 15 and is positioned opposite first hinged panel 25. Second hinged panel 70 may be pivoted onto and received by box 15 to act as a lid, sealing and enclosing box 15, and may be pivoted away from box 15 to open box 15.

Panel 25 typically includes a slot 75 formed therein and positioned opposite pipes 30, 35A, 35B, such that when deployed, panel 70 may be pivoted toward box 15 and the edge 80 of panel 70 may engage slot 75 to support panel 25. Box 15 and panel 70 typically include one or more hand grips 85 connected thereto or formed therethrough.

Box 15 and panels 25, 70 are typically formed from a rigid, structural material, such as wood, plastic, sheet metal, or the like.

Game kit 10 further includes one or more sets or pluralities 90 of (typically colored) tossing objects or bean bags 95. Typically, each set includes at least two, and more typically three, four or more bags 95 and is characterized by a unique color component and heft.

Methods of Play

In the above-described preferred embodiment, the game can be played by any number of players, typically two, three or four players. A player can be either an individual or a team. Each player chooses a side, left or right, to target. The order of play is determined by any convenient means, such as a coin toss or like means to determine which player (here represented by a color for the purpose of determining play order) goes first. Players are positioned, when it is their turn, to stand a predetermined distance from the pipes 30, 35A, 35B; typically, all players are positioned the same predetermined distance from the pipes on their turn, but players may be handicapped greater or lesser distances, depending on such factors as relative talent, previous success, penalties or rewards imposed, or the like. Each player takes a turn by attempting to toss a bag 95 into a pipe 30, 35A, 35B, either the ancillary pipe 35A, 35B residing on the player's predetermined side or the central pipe 30. Typically, the opening 45 of the central pipe 30 has a smaller diameter than the other openings 50A, 50B, and thus tossing a bag 95 into the central pipe scores more points.

Typically, one point is scored for each bag tossed into an ancillary pipe 35A, 35B, while two points are scored for tossing a bag into the central pipe 30, although other point values may be assigned. In some versions of play, additional points may be wagered or awarded, such as for especially difficult tosses. In other versions, points may be deducted for missing. In still other versions of play, the opposing player(s) may be awarded points if a player tosses his bag 95 into the ancillary pipe 35A, 35B residing on the side opposite that to which he is assigned.

In some versions of play, each player takes a single toss on his turn, and the turn then passes to the next player. In other versions of play, each player continues tossing bags until he misses. The game is won by the first player to reach an arbitrary goal, such as fifteen points.

Of course, all of these rules and variations are merely suggestions. Many variations of the method of play using the game kit 10, pipes 30, 35A, 35B and bags sets 90 are possible and will become apparent to those using the invention, particularly parents and teachers practicing the invention as a teaching tool.

Example

The game kit 10 as described above may be played according to the following rules and specifications.

Rule 1—Playing Area:

Section A. Dimensions-A playing area should be a level playing area, such as grass, carpet, concrete surface, or the like. The playing area consists of one Klooji game, and a foul line, located 15 feet from the front of the game pipes. If a measuring device is not present to determine 15 feet, 5 large strides from the front of the game can dictate the foul line if agreed upon by both players.

Section B. Foul line—A player must stand shoulder to shoulder with other player and toss from behind the foul line. Each player must be no farther than 5 feet apart from one another.

Section C. Players—2 players or 2 teams of 2 players each may be used. In the event a player or team may want to use 2 Klooji games to avoid walking back and forth after tossing, the $2^{nd}$ game should be placed staggered, not directly across from the foul line. See illustration below:

Rule 2—Playing Equipment

Section A. The following equipment specifications and standards are necessary for the game of Klooji:

1) Each Klooji game kit should be approximately 29" L×17" W×7" deep and constructed of ½" pvc plastic, wood, or equivalently rigid material.
2) Each Klooji game consists of 3 pipes attached vertically to the pivoting backboard of the Klooji game.
   a. Each pipe is approximately 13" in length.
   b. The side pipes top internal diameter opening is 4.25".
   c. The center pipe internal diameter is 3.75".
   d. From the ground to the top of the 2 side pipes is a minimum of 22".
   e. The center pipe height is 24" from the ground.
   f. The distance between openings at the top of the pipes should be 1" to allow for "Klingers" (bag is stuck between pipes)
   g. The backboard height is a maximum of 29" from ground to the highest point. This allows for "banking" a bag off of the backboard to fall into the pipe.
   h. The backboard must be at 90 degrees to the ground surface
   i. Each pipe must have the capacity to retain a minimum of 8 Klooji bags
   j. Each pipe has an opening on the bottom front face to allow for removal of Klooji bags after each round
3) The Klooji bags shall be made from synthetic suede material, with 2 panels, filled with plastic granules, 7 cm in diameter, and not to exceed 85 grams in weight. Each player will use 4 bags of the same pattern or color during play.

Rule 3—Throwing Distance

Section A. Adults—all adult contestants must stand a minimum of 15 feet from the backboard when positioned vertically. Each player must be no farther than 5 feet apart while throwing.

Section B. Children (under 12 years of age) may select any distance agreeable to throw from.

Rule 4—Play of the Game

Section A. Singles or Doubles Play—Klooji can be played as doubles or singles. In doubles play 2 contestants are partners against another team of 2 players. In singles, one contestant competes against another contestant. One game board or 2 may be used. But, it is not necessary to have 2 Klooji games to play doubles.

Section B. Rounds—every Klooji contest is broken down into rounds of play. During each round, each contestant must throw all 4 of their bags, in alternating tosses between competitors.

Rule 5—Scoring

Section A. Net gain Scoring—Each Klooji player is assigned their own side pipe, the player on the right of the other player accumulates points in the right side pipe and middle pipe. The player on the left side accumulates points in the left pipe and middle pipe. Only one player can score per round. If player A totals 5 points and player B totals 3 points, player A is awarded the NET GAIN of 2 points for that round.

Section B. Scoring in wrong pipe—If a Klooji player tosses his bag accidentally into his opponent's side pipe, the opponent adds that 1 point to his score. The middle pipe is always worth 2 points and the side pipes are worth 1.

Section C. Klingers and missed throws: If a Klooji player's bag is lodged between pipes (called a Klinger) or is hanging on the pipe opening, no point is scored. The bag must be 100% inside the pipe cylinder to score a point. A player with 2 Klingers in the same round is awarded the title of Klinger King for the round, but not points are assigned.

Section D. Winning the Game: Each player alternates tosses and adds to each rounds score with the net gain from the prior round. The winner is the $1^{st}$ Klooji player to reach 15 points or the highest score of the last round where 15 is reached. Ie. If the last round, player A has 16 and player B has 17, player B is the winner. It is not required to land on 15, or to win by 2 points.

While the novel technology has been illustrated and described in detail in the drawings and foregoing description, the same is to be considered as illustrative and not restrictive in character. It is understood that the embodiments have been shown and described in the foregoing specification in satisfaction of the best mode and enablement requirements. It is understood that one of ordinary skill in the art could readily make a nigh-infinite number of insubstantial changes and modifications to the above-described embodiments and that it would be impractical to attempt to describe all such embodiment variations in the present specification. Accordingly, it is understood that all changes and modifications that come within the spirit of the novel technology are desired to be protected.

What is claimed is:

1. A game kit, comprising:

an elongated rectangular box portion defining a recess;

a first elongated rectangular panel member hingedly connected to the box portion;

a second elongated rectangular panel member having a proximal edge and hingedly connected to the box portion;

a first pipe operationally connected to the first elongated rectangular panel portion;

a pair of ancillary pipes connected to the first elongated rectangular portion, wherein each respective ancillary pipe is positioned opposite the first pipe from the other respective ancillary pipe and wherein each ancillary pipe is equidistant from the first pipe;

a slot formed in the first elongated panel member opposite the first and ancillary pipes for receiving the proximal edge; and a plurality of bean bags;

wherein with the box portion placed on a generally flat surface, pivoting the first elongated rectangular panel member into a generally vertical orientation and pivoting the second elongated rectangular portion to engage the proximal edge with the slot deploys the first and ancillary pipes in a generally vertical orientation for receiving tossed bags.

2. The game system of claim 1 wherein the first pipe has a smaller diameter opening than the ancillary pipes.

3. The game system of claim 1 wherein the plurality of bags includes bags of a first color and bags of a second color.

* * * * *